US006487952B1

(12) United States Patent
Borgwarth et al.

(10) Patent No.: US 6,487,952 B1
(45) Date of Patent: Dec. 3, 2002

(54) REMOTE FIRE SYSTEM

(75) Inventors: Dennis W. Borgwarth, Anoka, MN (US); Brad J. Breeggemann, Maple Grove, MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 09/799,133

(22) Filed: Mar. 5, 2001

(51) Int. Cl.[7] ..... F41F 3/00
(52) U.S. Cl. ..... 89/1.81
(58) Field of Search ..... 89/1.81, 1.009

(56) References Cited

U.S. PATENT DOCUMENTS 2,818,807 A * 1/1958 Tracey, Jr. ..... 102/411
3,137,203 A * 6/1964 Brown ..... 102/411
3,158,062 A * 11/1964 Feiler ..... 102/413
3,499,364 A * 3/1970 D'Ooge ..... 89/1.81
3,838,642 A * 10/1974 Shimberg ..... 102/404
4,003,291 A * 1/1977 Vass et al. ..... 102/410
4,274,333 A * 6/1981 Lampton ..... 102/411
5,001,985 A * 3/1991 Reid et al. ..... 102/427
5,170,005 A * 12/1992 Mabry et al. ..... 89/1.11
5,542,333 A * 8/1996 Hagelberg et al. ..... 220/378

* cited by examiner

*Primary Examiner*—Charles T. Jordan
*Assistant Examiner*—Jordan M Lofdahl
(74) *Attorney, Agent, or Firm*—Patterson, Thuente, Skaar & Christensen, P.A.

(57) ABSTRACT

The present invention provides a method and apparatus for remote surface fire support. The remote surface fire support system of the present invention is designed to operate close to shore. The system is adapted to be deployed by a variety of means and remains concealed beneath the water's surface until it is to be launched. The system includes a plurality of munitions containers which can be deployed by submarines, surface ships or aircraft. The munitions containers each carry a guided munition which can be controlled by a networked fire control system such as NFCS.

22 Claims, 5 Drawing Sheets

REMOTE FIRE SYSTEM

FIELD OF THE INVENTION

The present invention relates to ordinance delivery systems for military missions and more particularly to a method and apparatus for remote fire delivery.

BACKGROUND OF THE INVENTION

The military is striving to expand its capability to conduct operations in the littoral regions of the world. They desire to project power from the sea to achieve strategic objectives and to support forces operating over and on the land. An integral part of this expanding capability is the ability of sea-based forces to project offensive fire support. Naval surface fires from the sea (NSFS) enable freedom of maneuver by joint and combined ground forces and successful prosecution of the joint land battle.

Land forces are being adapted for rapid deployment in the event of crises. Therefore, they are traveling lighter, with less or without traditional land based artillery. Naval surface fires are needed to augment reduced land based artillery. At the beginning of a conflict, NSFS may be the only artillery support available. An example of this principle is the Marine Corps' doctrine of Operational Maneuver From the Sea (OMFTS). The OMFTS doctrine stresses the use of rapid, decisive action with firepower and maneuver from the sanctuary of a sea base.

NSFS includes support provided by Navy surface gunnery, missile and electronic warfare systems in support of land units. In the wake of the cold war the Navy retired the last of its battleships, reducing naval surface fire support capability to the 5 inch/54 caliber gun with a maximum range of 13 nautical miles. Planned modifications to this weapon are expected to extend its range substantially.

Related to this concept of NSFS, the various branches of the U.S. armed forces have conceived of the idea of Networked Fire Controls such as the Naval Fire Control System (NFCS). The Navy's Naval Fire Control System (NFCS) gathers intelligence from a variety of sensors including satellites, AWACS, other aircraft and ground observers. The resulting sensor reports are analyzed by a land attack integrated product team (IPT). The IPT identifies targets, catalogues available sensors and collection systems, and decides target locations, priorities and response times. A fire decision center then decides how best to eliminate a particular target and chooses a weapon system to address the target most cost effectively.

There are two basic classes of artillery-fired ordinance. The first is so called "dumb projectiles." Conventional projectiles follow a ballistic trajectory defined by muzzle velocity and elevation and sweep of the gun barrel. Artillery used to fire these shells are large, robust and require a stable platform from which to operate to achieve accuracy. The effective range of such weapons is currently limited to about 20 miles.

The second basic class of naval rifle ordinance is competent munitions. Competent munitions are initially launched from a gun using propellant. Often, they also include rocket motors that ignite at a preset time to boost the munition's range. Once launched, these projectiles are actively guided to their intended target. Competent munitions equipped with rocket motors require less muzzle velocity to be able to reach an intended target than a conventional weapon would require. Competent munitions also do not require a particular trajectory to achieve accuracy. The optimum initial trajectory for competent munitions is often straight up. Guidance systems may include GPS and inertial guidance.

At ranges beyond the capability of artillery, a missile must be used to destroy a target. One example of a missile is the Tomahawk Land Attack Missile (TLAM). The TLAM was used in strike, interdiction, and suppression of enemy air defense (SEAD) missions in Desert Storm and Bosnia. Cruise missiles, such as the TLAM have a range of several hundred miles and employ an accurate internal guidance system. Missiles are strategic weapons and, as such, are not wasted on low priority targets. Strategic guided missiles typically cost upwards of $500,000.

Both missiles and projectiles play an important role in the fire and fire support missions of the modern military. In the NSFS arena, naval ships are strategically positioned near the coast of a potential target area where land based troops will land and secure an area. There may be hostile assets within striking distance of the landing area. The naval ships provide the required fire support to suppress hostile assets and provide cover fire for the land troops. Providing fire support requires that the ships be within effective range. That means that the fire support shipping must stand off shore. Maintaining ships at a great distance is not a viable option because of the limited range of available artillery. Effective range inland is the artillery range less the distance the ship must stand offshore. Exclusive use of missiles for fire support is prohibitively expensive and the quantity of missiles is limited.

There are significant drawbacks associated with placing ships near the shore. Initially, naval vessels are exposed to hostile attack. Naval vessels are costly assets and require years to construct. More importantly, there may be several hundred crew members exposed to risk. Ships exist in limited quantity and are difficult to conceal. This tends to deprive landing forces of the element of surprise. If enough fire support ships were available they could be dispersed to several different potential landing areas to draw off potential defenders.

Secondly, existing weaponry requires the presence of a stable launch platform such as a surface ship or submarine. Moving naval vessels within effective range of the intended target is time consuming and hard to conceal, thereby limiting quick strike ability. Additionally, the visibility of ships carry political overtones and limit tactical surprise. Further, many bodies of water are not accessible to shipping due to the depth and/or size of channels.

A need exists for a naval fire support weapon system that is unobtrusive, remains concealed until needed and that can be employed without excessively exposing personnel to enemy attack. The system should provide for launching weapons without the need for a visible launch platform. It would be desirable if the system could be flexibly deployed by air, surface or submarine vehicles. The system should support land attack as part of a coordinated NSFS operation and be adaptable to control by a joint integration and targeting system such as the NFCS.

SUMMARY OF THE INVENTION

The present invention substantially solves the above problems by providing a remote surface fire support system designed to operate close to shore. The system is adapted to be deployed by a variety of means and remains concealed beneath the water's surface until it is to be launched. The system includes a plurality of munitions containers which can be deployed by submarines, surface ships, or aircraft. The munition containers each carry a guided munition which can be controlled by a networked fire control system such as NFCS.

The munitions containers remain quiescent on the ocean floor until such time as it is desired to activate them. An activation signal is sent to the munitions container at the desired activation time which causes weights attached to the container to be released at which point the container and munition rises to the water's surface because of its positive buoyancy. Once the container has achieved the water's surface it will float until it receives an additional signal to launch its munitions. The system of the present invention is adaptable to a variety of different munitions including extended range guided munitions (ERGM), guided missiles, tactical missiles, and land attack standard missiles.

The system further includes a self-destruct mechanism that detonates the ordinance within the munitions container if an object should come into contact with the munitions container. This allows the remote surface fire support system to act as a mine if need be. The system may be used to attack shipping as controlled by the NFCS. In addition, the self-destruct mechanism may be activated by remote signal. Further, the self-destruct mechanism may be programmed to destroy the weapon after a certain selected period of time.

The system of the present invention is adaptable for use in a variety of bodies of water including rivers, lakes, and inland seas which are not normally accessible to naval shipping. Because the system of the present invention can be emplaced from a variety of platforms, it can be employed in different ways. The launch tubes can be quickly and discretely placed in the particular body of water. The launch tubes are adapted to be placed by submarines, ships, aircraft, and even fired from specialized gun systems.

If it is desired that a show of force be made, the system can be deployed from visible aircraft or shipping during daylight hours. In this situation it may be beneficial to include decoy munitions containers either to increase the potential difficulty of removing the containers by intermixing them with the active containers, or using only decoy containers in order to give an impression that attack is imminent providing tactical advantage at another location. Surreptitious deployment by aircraft or submarine is also an option.

The remote surface fire support system is remotely activatible using reliable, discrete, extreme low frequency communications methods as well as other methods. The system can be controlled from a remote command position and is adaptable to a networked fire control system such as the NFCS.

DETAILED DESCRIPTION OF THE PREFERRED EMBODIMENTS

Figure 1:
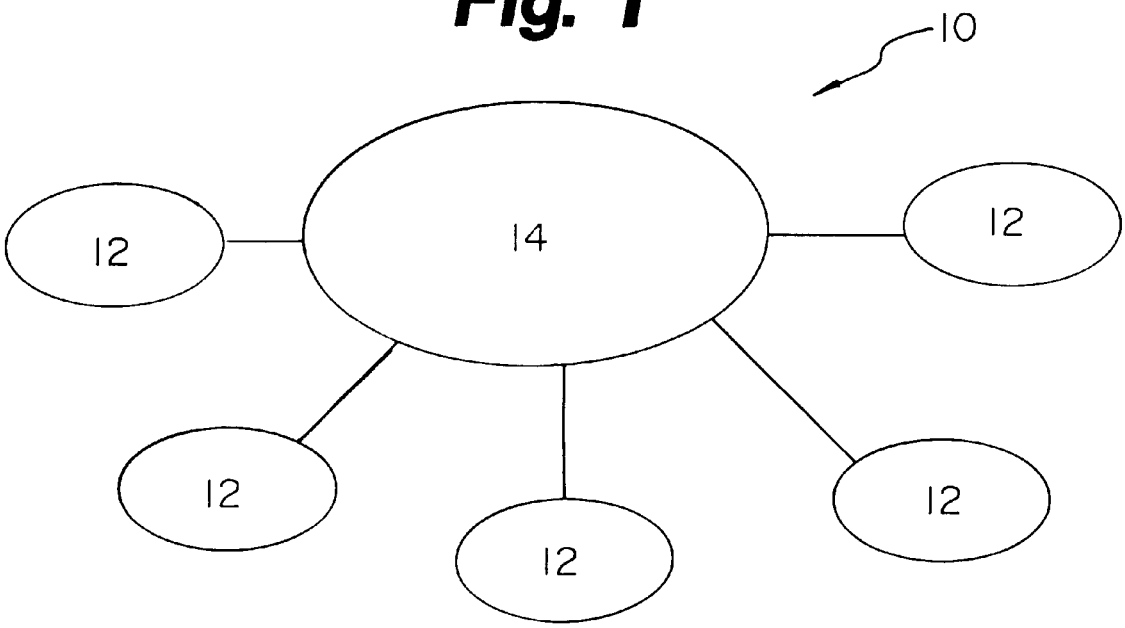
FIG. 1 is a block diagram of the remote fire support system in accordance with the present invention.

Referring to FIG. 1, the remote fire support system 10 generally includes a plurality of munitions containers 12 controlled by a networked firing system 14.

Figure 2:
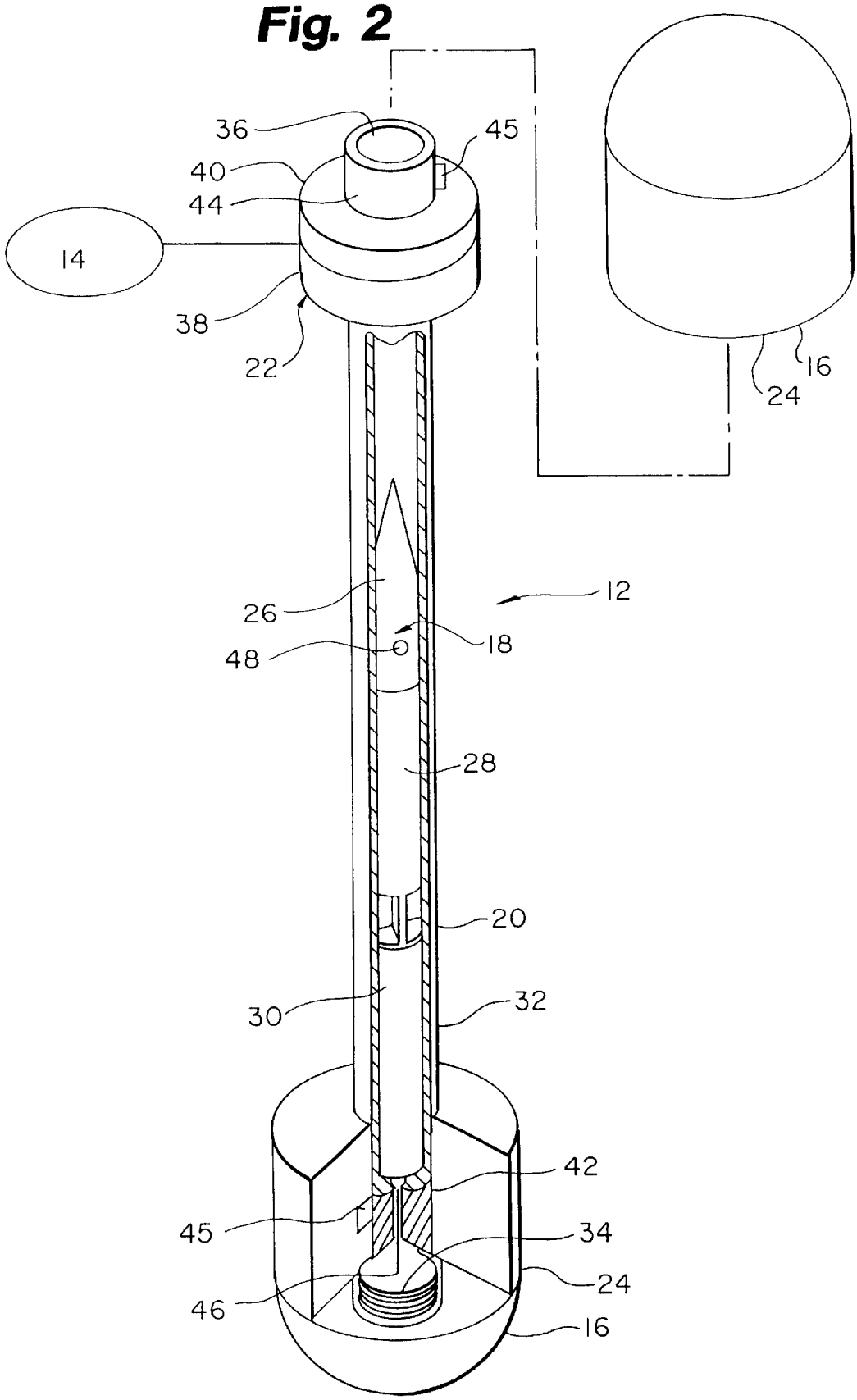
FIG. 2 is a partially exploded, cut away perspective view of a munitions container in accordance with the present inventions FIG. 3 schematically depicts the littoral environment in which the remote fire support system operates.

FIG. 2 depicts an exemplary munitions container 12. Each munitions container 12 generally includes ballast 16, a guided munition 18, a launch tube 20 and a control package 22. Ballast 16 includes a plurality of weights 24 each releasably secured to launch tube 20. Preferably two weights 24 are releasably secured to launch tube 20 one at each end thereof.

Munition 18 may include any of a variety of guided or competent munitions such as an extended range guided munition (ERGM), a land attack standard missile, or even a cruise missile. Any variety of guided weapons may be used. Munition 18 generally includes warhead 26, rocket propellant 28, and launch propellant 30.

Launch tube 20 includes tube 32, tether 34, and frangible seal 36. Launch tube 20 includes a closed end 42 and an openable end 44. Openable end 44 is sealed by frangible seal 36. Closed end 42 may include fuse 46. Tether 34 interconnects tube 32 and ballast 16. Launch tube 20 may be filled with a preservative gas (not shown) such as argon or another of the noble gasses. Launch tube 20 is preferably constructed of a composite material and is essentially a single use, disposable gun barrel in construction.

Control package 22 is secured to launch tube 20 and includes power supply 38 and communications and control electronic package 40. Control electronic package 40 is operably connected to ballast release mechanism 45 and fuse 46. Communication and control electronic package 40 is also optionally operably connected to munition fuse 48. Communication and control electronic package 40 may also include a shipping proximity sensor (not shown).

Communication and control electronic package 40 also preferably includes electronics to program and control a guidance system (not shown) incorporated into guided munition 18. The guidance system (not shown) may include GPS, inertial guidance, or any other guidance system known to those skilled in the art.

Ballast release mechanism 45 may include explosive bolts, solenoid actuators, servo actuated mechanical latches, or any other mechanism by which ballast may be securely attached to launch tube 20 and reliably released therefrom when desired.

Figure 3:
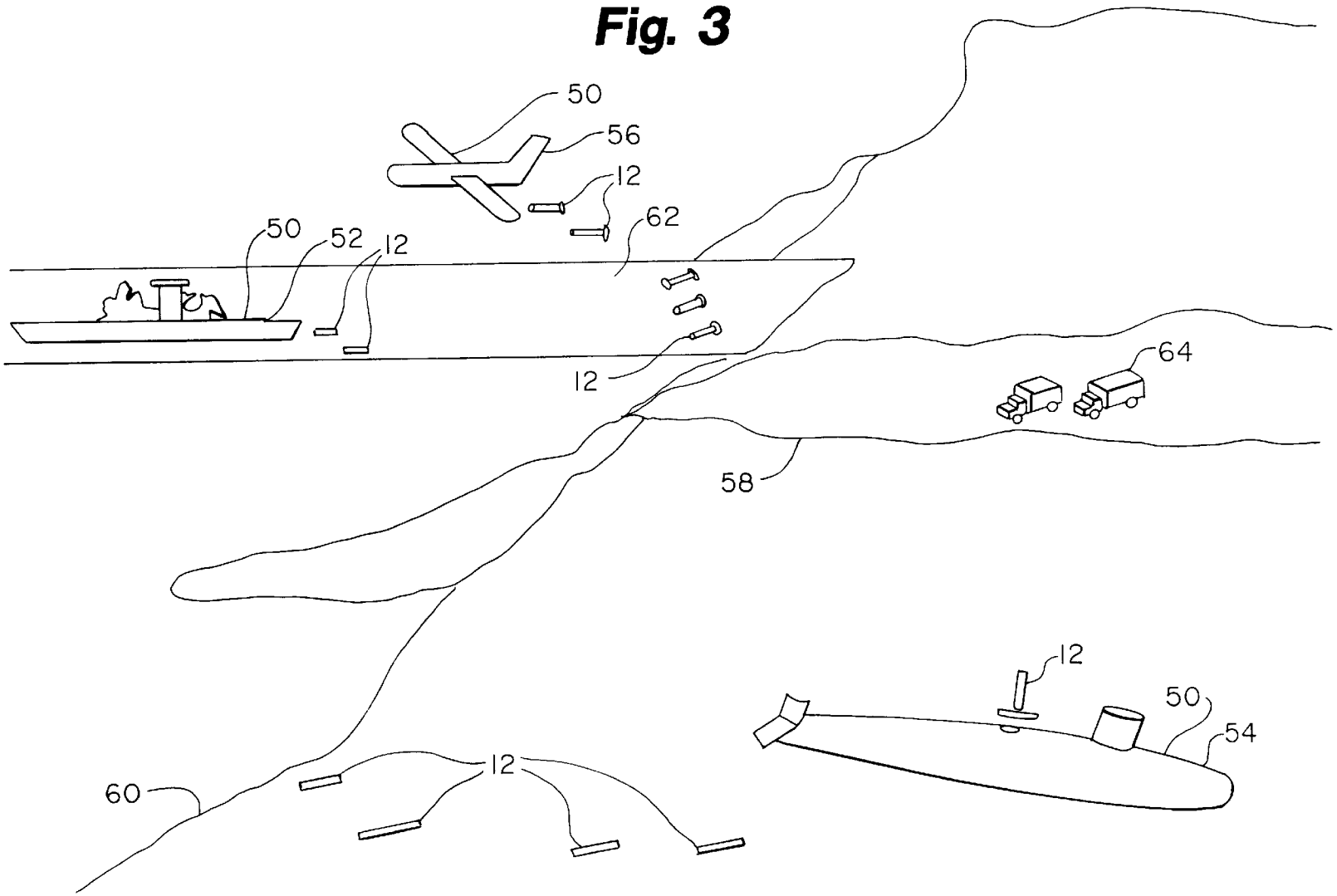
Figure 4:
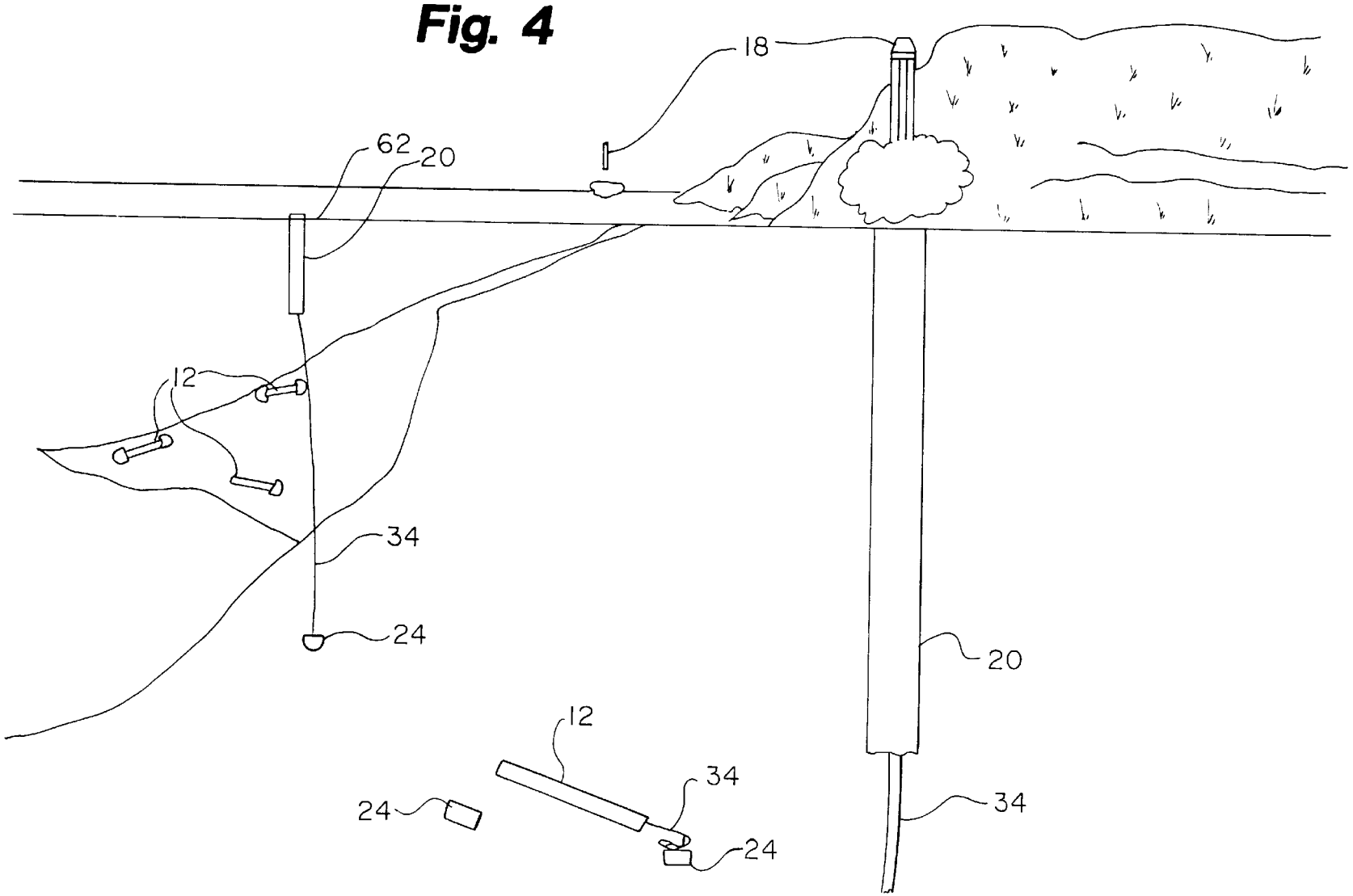
FIG. 4 schematically depicts the deployment of the remote fire support system in accordance with the present invention.
Figure 5:
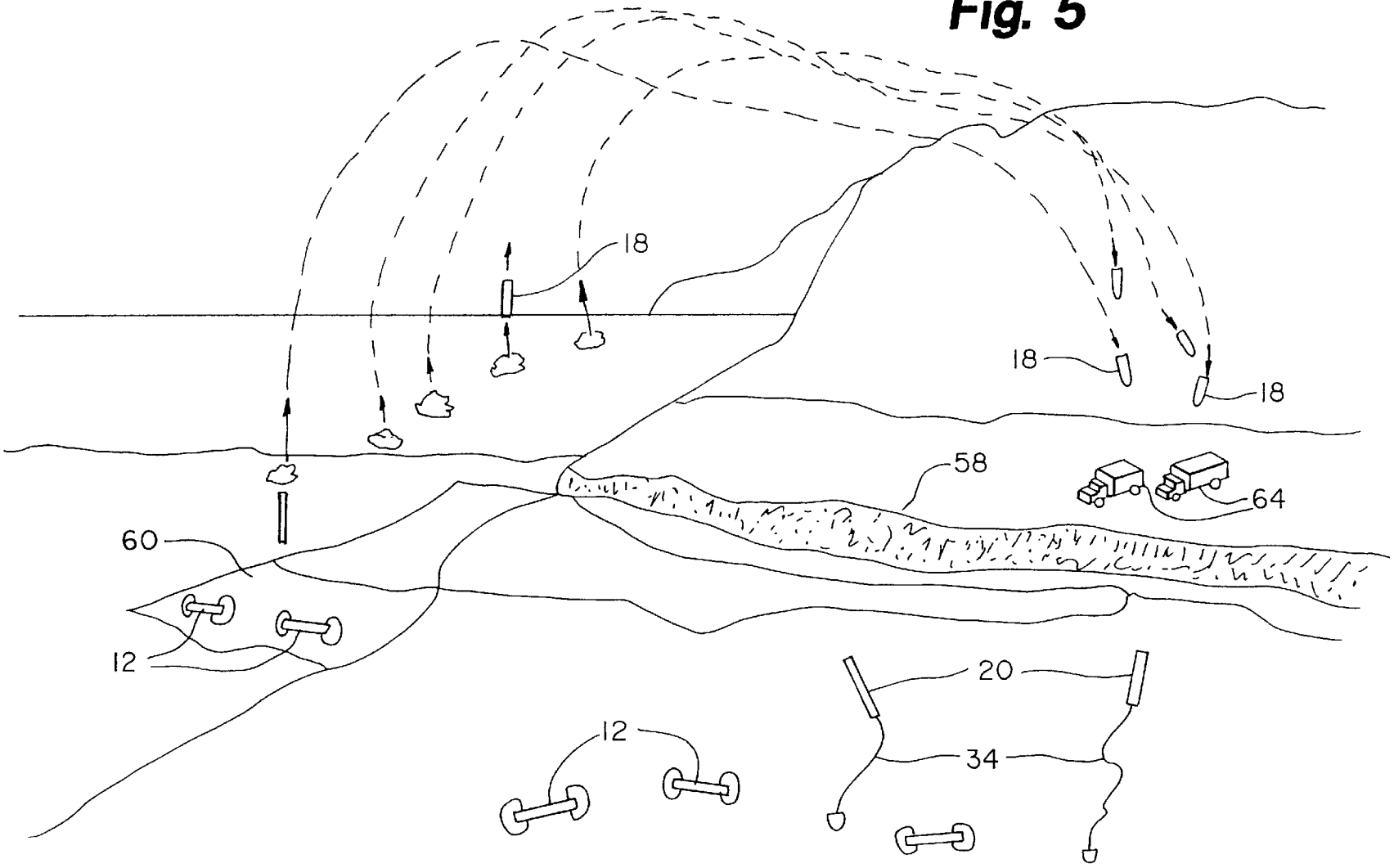
FIG. 5 schematically depicts launching of the remote fire support system in accordance with the present invention.

Referring to FIGS. 3, 4, and 5, remote fire support system 10 is configured to be deployable by transports 50. Transports 50 may include surface ships 52, submarines 54, or aircraft 56. Referring to FIGS. 3, 4, and 5, the littoral environment in which the present invention operates includes a coastline 58, sea bottom 60, water surface 62, and targets 64.

Networked firing system 14 communicates with communication and control electronic package 40 via extremely low frequency (ELF) radio, sound, laser, or any other communication medium known to those in the art. Networked firing system 14 is preferably the NFCS.

Referring to FIG. 3, in operation munitions containers 12 are dispersed along a coastline 58 by transports 50. Transports 50 may include a surface ship 52, a submarine 54, or aircraft 56. In the case of submarine 54 dispersal, munitions containers 12 may be adapted to be placed by expulsion through submarine missile tubes or torpedo tubes. In the case of dispersal by surface ship 52, munitions containers 12 may be rolled off the fantail of the ship into the water in a manner similar to depth charges or adapted to be placed by firing out of naval artillery. Aircraft 56 dispersal may be accomplished by, for example, dropping munitions containers 12 such as from the cargo bay of a C130 transport.

Referring to FIGS. 3 and 4, munitions containers 12 sink to the sea bottom 60 due to gravity and lie quiescent there.

Because of their location beneath the water surface 62, munitions containers 12 are effectively concealed from discovery and made difficult to remove without considerable effort. When it is desired to activate remote fire support system 10, networked firing system 14 signals control electronic package 40 to release ballast 16. Control electronic package 40 then releases releasable weights 24. Munitions container 12 then rises to the surface because of its natural buoyancy. Munitions container 12 may remain attached to ballast 16 by tether 34. Tether 34 then acts to maintain munitions container 12 at a desired location. Munitions container 12 is configured to float in an upright orientation with frangible seal 36 uppermost.

Referring to FIG. 5, when it is desired to launch munition 18, networked firing system 14 relays a signal to control electronic package 40 which programs guidance system (not shown) of munition 18 with targeting information. Targeting information may include the location of targets 64 and other appropriate information. Thereafter, networked firing system 14 signals control electronic package 40 to ignite fuse 46 whereupon launch propellant 30 begins to bum. The rapid expansion of gases caused by launch propellant 30 burning causes warhead 26 to be forcibly ejected from launch tube 20 much like a shell from a cannon. As warhead 26 ascends in launch tube 20, frangible seal 36 gives way allowing warhead 26 along with rocket propellant 28 to exit launch tube 20. Munition may also fire in response to proximity of a ship sensed by proximity sensor (not shown). In this way it acts similarly to a naval mine.

Once free of launch tube 20, rocket propellant 28 ignites carrying warhead 26 to a desired altitude. Guidance system (not shown) then guides munition 18 to the location of its desired targets 64.

If munitions container 12 is placed on sea bottom 60 and it is later desired not to launch munition 18, a self-destruct signal may be sent from networked firing system 14 to control electronic package 40. Control electronic package 40 then activates munition fuse 48 causing munition 18 to explode effectively destroying munition container 12. Alternately, control electronic package 40 may activate fuse 46 firing munition 18 straight up without guidance information. Munition 18 then will return straight down to the location of munitions container 12 causing self-destruction. Alternately, control electronic package 40 may include a timing circuit to activate the self-destruct sequence at a particular time after placement.

Remote fire support system 10 may also be utilized as an anti-shipping weapon. When used as an anti-shipping weapon networked firing system 14 instructs control electronic package 40 to program guidance system (not shown) with the appropriate shipping target.

Preservative gas (not shown) prevents corrosion due to oxidation and extends the shelf-life and ocean bottom concealed life of the contents of munitions container 12.

The present invention may be embodied in other specific forms without departing from the essential attributes thereof, therefore, the illustrated embodiment should be considered in all respects as illustrative and not restrictive, reference being made to the appended claims rather than to the foregoing description to indicate the scope of the invention.

What is claimed is:

1. A remote fire support system for deployment and launching in a body of water having a bottom, the remote fire: support system comprising:

a guided munition having a positive buoyancy in water;

a ballast releasably attached to the munition, said ballast together with said munition having a negative buoyancy in water, said ballast remaining attached to the munition until the munition is to be launched and arranged so that the munition lies on the bottom of the,body of water until the ballast is released from the a control package; and a networked firing system operably in communication with said control package, the control package being capable of releasing said ballast upon a signal from said networked firing system and further being capable of launching said guided munition.

2. The remote fire support system as claimed in claim 1, further comprising a munition container.

3. The remote fire support system of claim 1, wherein said signal is by extremely low frequency (ELF) carrier wave.

4. The remote fire support system of claim 2, further comprising a further interconnecting said munitions container and said ballast whereby said munitions container is anchored in a chosen location.

5. The remote fire support system of claim 2, in which the munitions container is adapted to be deployed by submarine.

6. The remote fire support system of claim 2, in which the munitions container is adapted to be deployed by aircraft.

7. The remote fire support system of claim 1, in which the munitions container is adapted to be deployed by surface shipping.

8. The remote fire support system of claim 2, said guided munition further comprising a self-destruct mechanism.

9. The remote fire support system of claim 2, wherein the launch tube further comprises a self-destruct sensor for activating the munition upon proximity with an object.

10. A method of providing remote surface fire support from shallow water deployment, comprising the steps of:

dispersing a plurality of guided munitions in a body of water, the body of water having a surface and a bottom, each said guided munition having a ballast releasably attached thereto, said guided munition being positively buoyant in water, the ballast together with the guided munition being negatively buoyant in water, and said ballast remaining attached to the munition until the munition is to be launched and arranged so that the munition lies on the bottom of the body of water until the ballast is released from the munition;

releasing the ballast;

waiting for the guided munition to rise to the surface; and launching the guided munition, whereby the guided munition may be concealed from discovery until launch is desired.

11. The method as claimed in claim 10, further comprising the step of tethering said guided munition to said ballast, whereby the guided munition is maintained in a desired area.

12. The method as claimed in claim 10, in which said releasing of ballast is initiated by a first remote signal.

13. The method as claimed in claim 10, in which said launching of said guided munition is initiated by a second remote signal.

14. The method as claimed in claim 10, further comprising the step of programming a guidance system of said guided munition whereby targeting is achieved.

15. The method as claimed in claim 10, in which said dispersing step is accomplished by a modality selected from a group consisting of aircraft, ship and submersible.

16. The method as claimed in claim 10, further comprising the step of enclosing said guided munition in a munitions container whereby said guided munition is protected from exposure to said body of water.

17. The method as claimed in claim 10, further comprising the steps of:

equipping said guided munition with a self destruct mechanism, and initiating said self destruct mechanism, whereby said guided munition may be destroyed if desired.

18. The method as claimed in claim 10, further comprising the step of equipping the guided munition with a proximity sensor whereby said guided munition launch may be initiated by proximity to a desired object.

19. A remote fire support system for deployment and munition launching in a body of water having a bottom, the remote fire support system comprising:

a guided munition having a positive buoyancy in water, wherein the guided munition has a first end and a second end;

a first ballast releasably attached to the first end;

a second ballast releasably attached to the second end, wherein the first ballast and the second ballast together with the munition having a negative buoyancy in water, wherein the first ballast and the second ballast remain attached to the munition until the munition is to be launched;

a control package; and a networked firing system operably in communication with said control package, the control package being capable of releasing said ballast upon a signal from said networked firing system and further being capable of launching said guided munition.

20. The remote fire support system of claim 19, wherein the first ballast and the second ballast are arranged so that the munition lies on the bottom of the body of water until the first ballast and the second ballast are released from the munition.

21. The remote fire support system of claim 19, and further comprising a munition container.

22. The remote fire support system of claim 19, and further comprising a self-destruct mechanism.

* * * * *